US005906388A

United States Patent [19]

Neiley

[11] Patent Number: 5,906,388

[45] Date of Patent: May 25, 1999

[54] FOOTWEAR MOUNTING SYSTEM

[75] Inventor: Roger T. Neiley, Monarch Beach, Calif.

[73] Assignee: Quiksilver, Inc., Costa Mesa, Calif.

[21] Appl. No.: 08/782,657

[22] Filed: Jan. 14, 1997

[51] Int. Cl.[6] ..... A63C 9/00

[52] U.S. Cl. ..... 280/613; 280/14.2; 280/611

[58] Field of Search ..... 280/14.2, 613, 280/607, 617, 611, 623

[56] References Cited

U.S. PATENT DOCUMENTS

| | | | |
|---|---|---|---|
| 3,988,841 | 11/1976 | Salomon . | |
| 4,042,257 | 8/1977 | Salomon . | |
| 4,290,213 | 9/1981 | Salomon . | |
| 4,316,618 | 2/1982 | Sampson | 280/613 |
| 4,418,937 | 12/1983 | Salomon | 280/613 |
| 4,728,115 | 3/1988 | Pozzobon et al. . | |
| 4,728,116 | 3/1988 | Hill . | |
| 4,836,572 | 6/1989 | Pozzobon . | |
| 4,955,632 | 9/1990 | Prestipino Giarritta et al. . | |
| 4,973,073 | 11/1990 | Raines et al. . | |
| 5,035,443 | 7/1991 | Kinocheloe | 280/14.2 |
| 5,143,395 | 9/1992 | Mayr | 280/617 |
| 5,172,924 | 12/1992 | Barci . | |
| 5,190,311 | 3/1993 | Carpenter et al. . | |
| 5,236,216 | 8/1993 | Ratzek . | |
| 5,261,689 | 11/1993 | Carpenter et al. . | |
| 5,356,170 | 10/1994 | Carpenter et al. . | |
| 5,474,322 | 12/1995 | Perkins et al. . | |
| 5,480,176 | 1/1996 | Sims . | |
| 5,505,477 | 4/1996 | Turner et al. . | |
| 5,505,478 | 4/1996 | Napoliello | 280/14.2 |
| 5,520,405 | 5/1996 | Bourke . | |
| 5,520,406 | 5/1996 | Anderson et al. . | |
| 5,553,883 | 9/1996 | Erb . | |

FOREIGN PATENT DOCUMENTS

| | | |
|---|---|---|
| 0 707 873 A1 | 4/1996 | European Pat. Off. . |
| 0705625 | 4/1996 | European Pat. Off. . |
| 2 282 823 | 3/1976 | France . |

*Primary Examiner*—Lanna Mai
*Assistant Examiner*—Michael Cuff
*Attorney, Agent, or Firm*—Knobbe, Martens, Olson & Bear, LLP.

[57] ABSTRACT

A binding system is configured to removably mount a footwear member to a sporting or recreational device. In a preferred embodiment, the binding system includes a binding member having at least one rail attached thereto. The rail preferably has an elongated, arcuate shape. A corresponding slot on the footwear member is configured to slidingly receive the rail. The cross-sectional shape of the slot conforms to the cross-sectional shape of the rail. The footwear member is mounted to the binding member by aligning the rail and slot and slidingly inserting the rail into the slot using a rotational motion.

30 Claims, 10 Drawing Sheets

FOOTWEAR MOUNTING SYSTEM

BACKGROUND OF THE INVENTION

1. Field of the Invention

This invention relates generally to a device for mounting footwear to an object, and, more particularly, to a device for removably mounting a footwear member to a sporting or recreational device.

2. Description of the Related Art

Many sports require that a person's foot be attached to a sporting device. The person's foot is supported by a footwear member, such as a boot, shoe, or other footwear device that is specially suited for the particular sport. Some examples of such sports include snow and water skiing, various types of skating, and snowboarding.

Snowboarding is one of the fastest-growing winter sports in the world. Snowboarders wear various types of boots when snowboarding, which are attached to the snowboard with a binding. The snowboarder places each boot into a binding and rides the snowboard across a snowy surface. Typically, both of the snowboarder's feet are completely or partially transversely oriented relative to the longitudinal axis of the snowboard. The snowboarders boots must be bound to the snowboard so that the snowboarder will not become separated from the snowboard during movement.

There are currently a large number of binding systems that are used to bind a snowboarder's boots to the snowboard. One type of snowboard boot binding is a conventional strap-on binding. This type of binding employs a series of straps that extend around the exterior of the boot from the surface of the snowboard where the boots are mounted. The straps are fixed around the boot by closure tightening mechanisms, such as latches. The snowboarder places his or her boot on the snowboard and then secures the boot to the snowboard by wrapping and tightening the straps around the boot.

Another type of snowboard binding that is currently used is a so-called step-in binding, similar to the type that is conventionally used with snow skis. With a step-in binding, the attachment occurs when a snowboarder steps downwardly into a latching device which is mounted on the snowboard. The snowboarder's boot exerts a downward force on the binding, which triggers a mechanism in the binding device, causing a latch or hook to be released. The latch or hook engages a recess or other bearing surface in the boot that is configured to receive the latch. The latch thus couples to the boot to thereby secure the boot the snowboard. In order to release the boot, the snowboarder manually disengages the latch or hook from the recess or whichever type of bearing surface that is used.

Certain drawbacks are associated with prior snowboard boot binding systems. Strap-on binding systems are often inconvenient to use. In order to bind a boot to a snowboard using a strap-on system, the snowboarder must use his or her hands to grab and tighten the straps around the boot. This may be difficult if the snowboarder is wearing gloves, as is often the case. Consequently, the snowboarder may have to remove his or her gloves, which is uncomfortable and unsafe in cold weather. Furthermore, the snowboarder must generally sit down or stoop in order to bind the straps to the boot. This may be inconvenient and uncomfortable, especially in the snow or on inclined slopes. Moreover, snow is often packed in the latches, which makes them difficult to operate. Hence, the snowboarder must manually remove the snow before binding the boot, which is both inconvenient and time-consuming.

There are also a number of drawbacks associated with step-in binding systems. First, step-in systems typically employ complex mechanics with a number of moving parts. As a result, step-in systems are susceptible to malfunctions caused by mechanical failure. Furthermore, the moving parts in the step-in system may cause bearing surfaces to wear down quickly, which reduces the life of the binding. The mechanics of step-in systems also make such systems costly and difficult to manufacture, which raises the price of such systems.

Another drawback associated with step-in systems is that debris may get caught in the boot or binding recess which receive the securing latch or hook. The latch couples to the boot in such a way that when the snowboarder steps into the binding device, the latch packs and compresses any debris in the recess, which interferes with the coupling of the latch to the recess. This is especially undesirable for snow, which can be packed into a hard ice and is difficult to remove from the recess. In order to avoid this problem, the snowboarder must take time to clear the recess of snow prior to stepping into the binding. This is inconvenient, especially if the snowboarder is wearing gloves.

Due to the way a snowboarder's feet are oriented on the snowboard, it may also be difficult for a snowboarder to generate sufficient downward force to trigger the latching mechanism of a step-in binding. A proper snowboard stance requires that the snowboarder's feet be spaced apart from each other on the snowboard. After the first foot is attached to the step-in binding on the snowboard, the angle of the snowboarder's second foot relative to the snowboard makes it difficult and awkward for the snowboarder to exert a downward force into the binding. As a result, a snowboarder may have considerable difficulty binding the second foot to the snowboard.

Given these drawbacks, there is a need for a binding system having a simple, reliable design that may be used to easily and conveniently mount a footwear member, such as a boot or shoe, to a snowboard or other recreational device.

SUMMARY OF THE INVENTION

The present invention is a binding system which may be used to mount a footwear member to various sporting or recreational devices, such as, for example, snowboards, skis, skates, etc. Although described and illustrated herein in the context of snowboard bindings, the features of the present invention are broadly applicable to a wide variety of sports or recreational devices and are not limited to snowboards.

The footwear mounting system described herein has a simple, unique design with a number of advantages over the prior art. The mounting system allows a user to easily mount a footwear member, such as a boot, to a sporting device using a natural biomechanical leg motion that does not involve the user's hands so that the user does not have to stoop or sit during mounting. Once the first foot is mounted, it is not difficult or awkward to mount the second foot using the leg motion. Debris, such as snow, is automatically ejected from the engagement surfaces during the mounting process so that mounting is easily and quickly accomplished. Furthermore, a locking mechanism automatically locks the footwear member to the sporting device when the footwear member is in the correct position. The mounting system uses a minimum number of moving parts so that the system is reliable and is not prone to malfunctions.

In one aspect of the invention, the footwear member is slidingly mounted to the sporting device in a direction generally parallel to the surface of the sole on the footwear member. At least one rail is preferably located on the sporting device. A corresponding slot, which is configured to slidingly receive the rail, is preferably located on the sole of the footwear member. The rail and slot together define a mating engagement between the footwear member and sporting device. The cross-sectional shape of the mating engagement may have two components, including a first upright component and a second component oriented substantially transverse relative to the upright component. Alternatively, the components of the mating engagement may be integrally formed into a single component such that the cross-sectional shape restricts relative movement between the footwear member and the sporting device.

In a preferred embodiment, two rails and two slots are used. The rails and slots have a common radius of curvature so that mounting involves a rotational movement that the user accomplishes by rotating his or her ankle. The rotational movement is easily accomplished and allows the user to generate high levels of force sufficient to slide the rails into the slots.

In another aspect of the invention, debris, such as snow, is automatically ejected from the slots during the mounting process. As the rail is slidingly inserted into the slot, the leading edge of the rail forces debris out of the slot so that the debris is ultimately ejected through one end of the slot. The sliding motion between the slot and the rail advantageously does not compact or compress debris within the slot. Hence, the user does not have to remove debris, such as snow, prior to binding the footwear member to the sporting device, making the mounting system easy to use.

In yet another aspect of the invention, a locking mechanism secures the footwear member against undesired movement relative to the sporting device when the footwear member is correctly mounted on the sporting device. The locking mechanism includes a pin that extends through the sole of the footwear member. The pin automatically engages a notch on one of the rails when the footwear member is in the correct orientation relative to the sporting device.

Hence, the footwear mounting system may be used to quickly and conveniently mount a footwear member to a variety of sporting devices. The method of mounting the footwear member is easily accomplished by the user with a natural rotational motion of the leg. Prior to mounting, the user may kick any snow or other debris from the mounting surfaces to facilitate a smooth mounting. Further, the system may be operated when standing, which is convenient for the user, especially on slopes or in snow. The mounting system is designed to automatically removes debris from the mounting surfaces so that the user does not have to concern himself with cleaning the mounting surfaces prior to mounting. The locking mechanism assures that the user orients the footwear member in the correct position relative to the sporting device. Finally, the mounting system is simple in design with a minimum number of mechanical parts so that the system is highly reliable.

Disclosed is a mounting system adapted for coupling a footwear member of a user to a recreational device such as a snowboard, and the like. The system comprises at least one, first mounting device on the recreational device and at least one, second corresponding mounting device on the footwear member adapted for mating engagement with the first mounting device on the recreational device. The first and second mounting devices slidably and rotatably engage one another in substantially the same engagement plane which is also substantially parallel to the mounting plane of the recreational device. The mating engagement has a general cross-sectional configuration including at least one upright member to substantially prevent relative movement between the recreational device and the footwear member in the engagement plane and at least one planer member to substantially prevent relative movement between the recreational device and the footwear member in a plane substantially transverse to the engagement plane.

Further disclosed is a mounting system adapted for coupling a footwear member of a user to a recreational device such as a snowboard, and the like, comprising at least one, first mounting device on the recreational device and at least one, second corresponding mounting device on the footwear member adapted for mating engagement with the mounting device on the recreational device. The first and second mounting devices slidably engage one another in substantially the same engagement plane. The mating engagement has a general cross-sectional configuration including at least a first portion to prevent relative movement between the recreational device and the footwear member in the engagement plane, and at least a second portion to substantially prevent relative movement between the recreational device and the footwear member in a plane substantially transverse to the engagement plane.

Thus, the present invention provides many advantages over the mounting systems of the prior art. The footwear mounting system of the present invention has a simple, reliable design that may be used to easily and conveniently mount a footwear member, such as a boot or shoe, to a snowboard or other recreational device.

BRIEF DESCRIPTION OF THE DRAWINGS

These and other features of the invention will now be described with reference to the drawings of preferred embodiments of the snowboard binding system. The illustrated embodiments of the binding system are intended to illustrate, but not to limit the invention.

FIG. 10*b* is a bottom plan view of the footwear member illustrated in FIG. 10*a.

DETAILED DESCRIPTION OF THE PREFERRED EMBODIMENT

Figure 1:
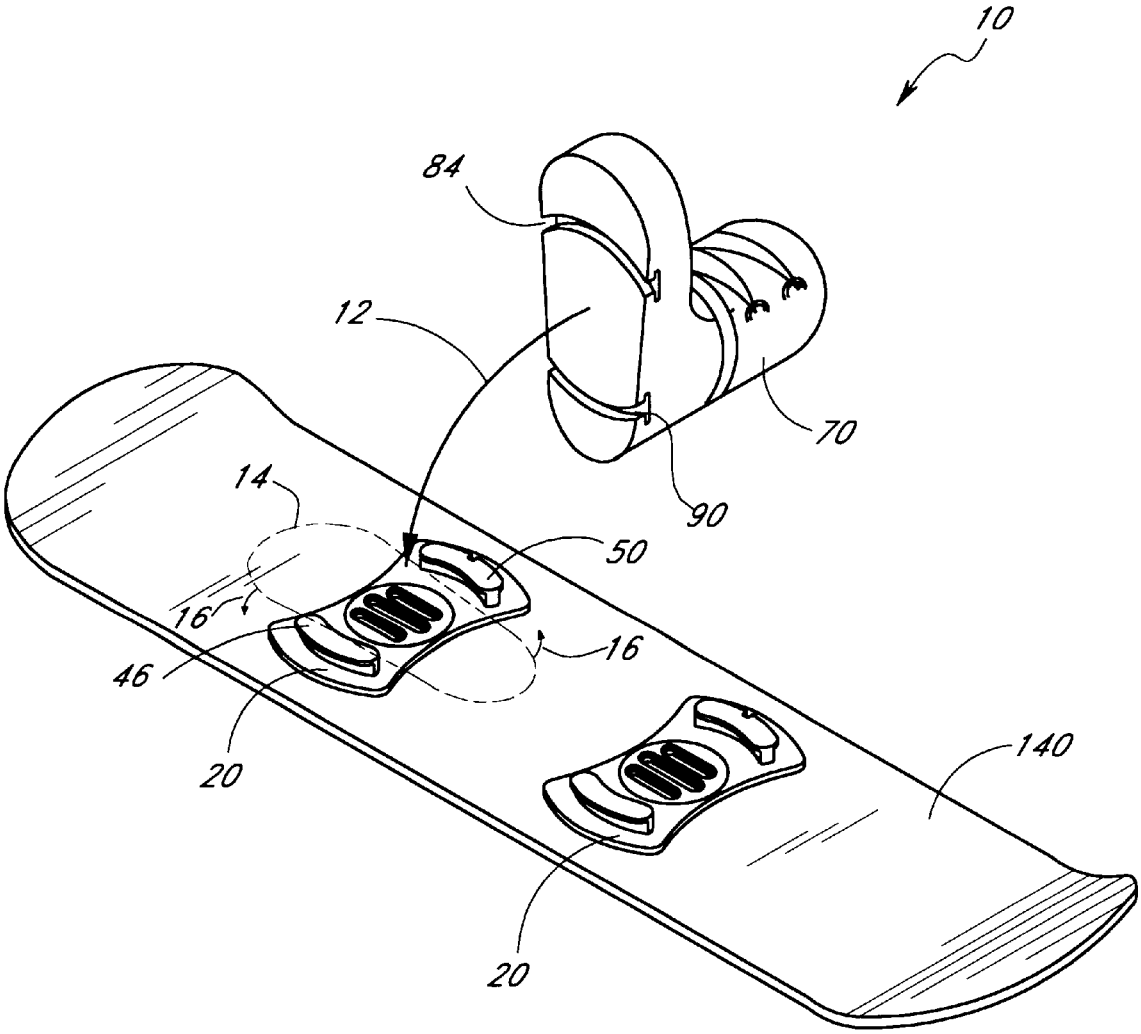
FIG. 1 illustrates a perspective view of the footwear binding system of the present invention.

FIG. 1 illustrates a footwear mounting system 10. The mounting system 10 includes at least one binding member 20, which is attached to a sporting device, such as a snowboard 140. The mounting system 10 also includes at least one footwear member 70, such as a boot, shoe, etc, which is configured to slidably attach to the binding member 20. The mounting system 10 may be used to removably mount the footwear member 70 to the sporting device, as described below. The following description is oriented towards mounting the footwear member 70 to a planar member, such as the snowboard 140. However, as noted above, the description with respect to a snowboard is merely exemplary and the present binding system 10 could be used to mount a footwear member 70 to a wide variety other objects as well, such as skates, skis, etc.

As shown in FIG. 1, in one embodiment, each binding member 20 includes a pair of rails 46, 50, that are spaced apart along the longitudinal axis of the binding member 20. Each rail 46, 50 has a curvature that facilitates rotatable mounting of the footwear member 70 onto the binding member 20. The cross-sectional shape of the rails 46, 50 is advantageously configured to substantially conform to mating surfaces on the shoe 70, as described in more detail below.

Referring to FIG. 1, a pair of slots 84, 90 extends through the sole of the footwear member 70. The slots 84, 90 are configured to slidingly receive and mate with the rails 46, 50 on the binding member 20, as described more fully below.

When the footwear member 70 is fully mounted and engaged with the binding member 20, the longitudinal axis of the footwear member 70 is substantially aligned with the longitudinal axis of the binding member 20, as illustrated by the arrow 12 of FIG. 1. However, the mounted position is achieved by first positioning the footwear member 70 between the rails 46, 50 so that the footwear member 70 is oriented transverse relative to the longitudinal axis of the binding member 20, as illustrated in FIG. 1 by the phantom profile 14 of the footwear member 70. This allows the wearer to kick snow or other debris from the binding member 20 so that the sole of the footwear member may be placed substantially flat against the binding member 20 with the slots 46, 50 adjacent the rails 84, 90, respectively. The footwear member 70 is then rotated approximately 90 degrees to mate with the binding member 20, as illustrated by the arrows 16 in FIG. 1. The footwear member 70 may be mounted using either clockwise or counter-clockwise rotation.

It will be appreciated that the principles of the present invention are not limited to rotational mounting. Moreover, the number of rails and slots that are used may be varied. The cross-sectional shape of the rails and slots may also be varied and remain within the scope of the present invention.

Binding Member

Figure 2:
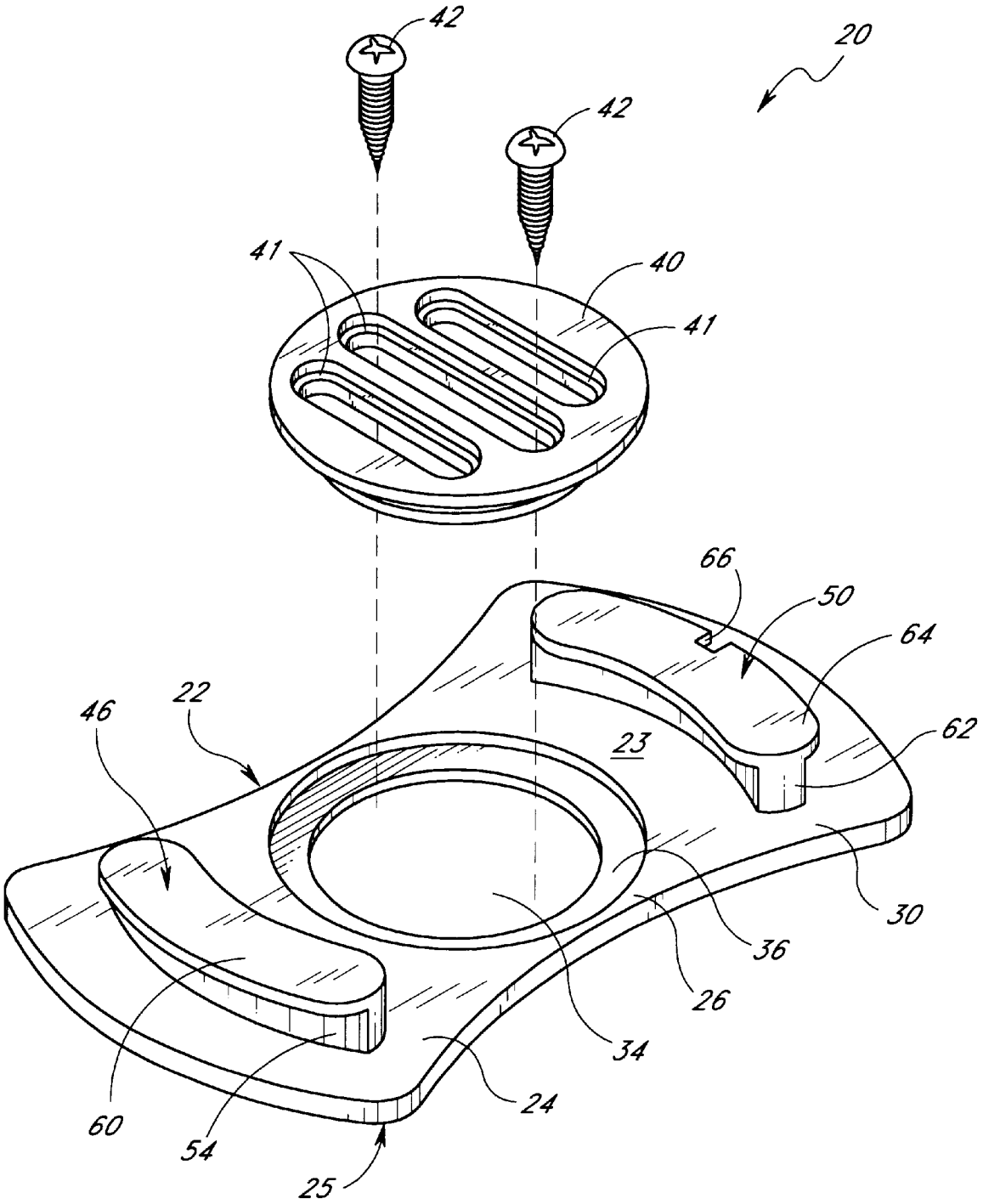
FIG. 2 illustrates a perspective view of a binding member of the footwear mounting system in accordance with a preferred embodiment of the present invention.
Figure 3:
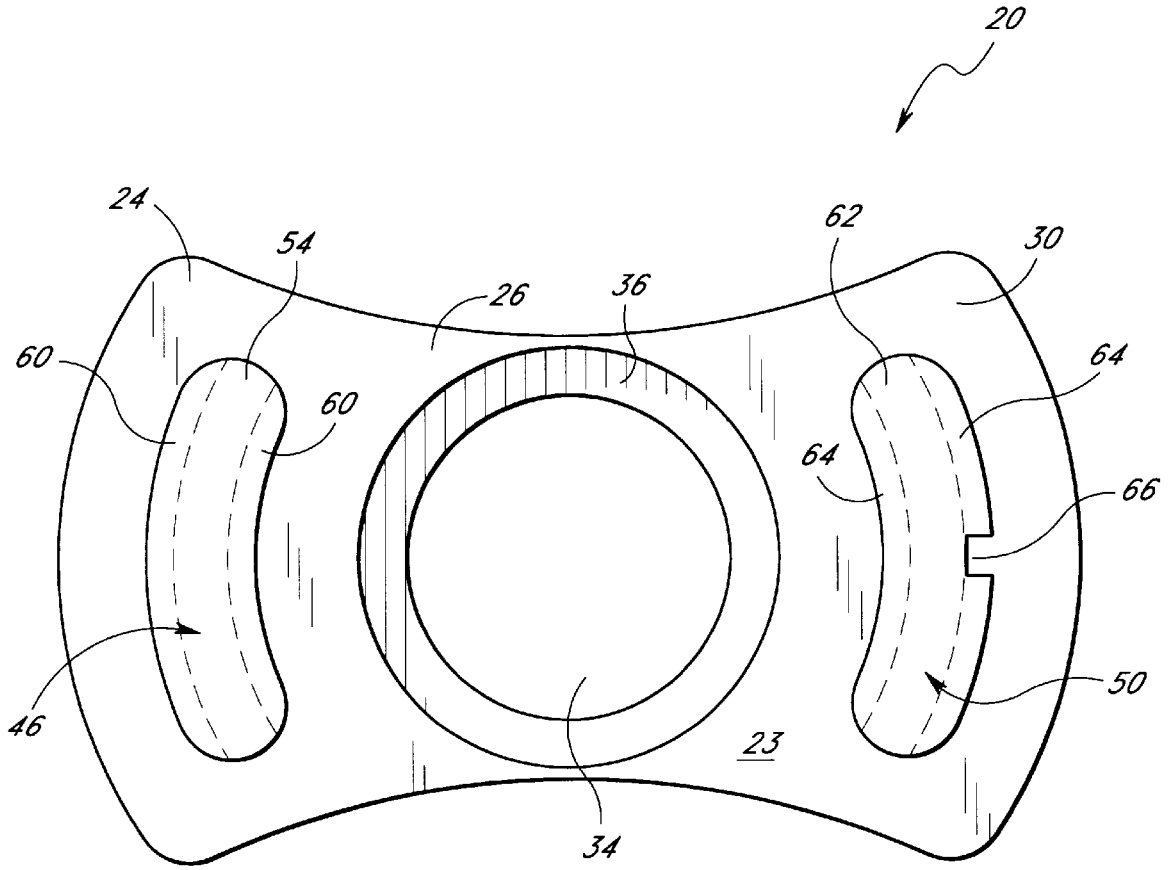
FIG. 3 illustrates a top plan view of the binding member of FIG. 1.

FIGS. 2 and 3 illustrate a preferred embodiment of the binding member 20 of the footwear mounting system 10. It will be appreciated that the binding member 20 could be any kind of support for engagement between the rails 46, 50 and the slots 84, 90.

Referring to FIG. 2, the binding member 20 includes a generally planar plate 22 having a top surface 23 and a bottom surface 25 (not shown). The plate 22 has a front section 24, a middle section 26, and rear section 30. As used herein, the words "front" and "rear" are with reference to the front and rear portions of a foot and are not intended to limit the scope of the invention.

Referring to FIG. 2, the plate 22 has a width that smoothly increases in the direction of the front and rear sections 24 and 30. Hence, the width of the middle section 26 is smaller than the width of the front and rear sections 24 and 30. The plate thus has a substantially "hourglass" shape, as best seen in FIG. 3. However, it will be appreciated that the plate 22 could take on a wide variety of shapes and remain within the scope of the invention.

With reference to FIG. 2, a circular aperture 34 extends through the plate 22. Preferably, the circular aperture has a center point that is aligned with the center point of the plate 22. A circular recessed section 36 surrounds the circular aperture 34 on the plate 22. Together, the aperture 34 and the recessed section 36 are configured to receive a mounting device 40 for mounting the binding member 20 to a planar member (not shown), such as a snowboard. In the illustrated embodiment, the mounting device 40 is a conventional Hirth Curvic Coupling-type device, as is known to those skilled in the art. The mounting device 40 has three oblong slots 41 that may receive bolts or screws 42 for attaching the binding member 20 to a planar member. It will be appreciated that other means could be used to attach the binding member 40 to a board, such as an adhesive or bolts that extend through individual apertures formed in the plate 22.

The plate 22 is preferably formed of a rigid material, such as a metal, including steel or aluminum. Alternatively, the plate 22 could be manufactured of a rigid plastic or composite material. Those skilled in the art will appreciate that a wide variety of materials could be used to manufacture the plate 22.

Referring to FIG. 2, a front rail 46 and a rear rail 50 are located on the top surface 23 of the plate member 22. The front rail 46 is positioned on the front section 24. An upright component 54 of the front rail 46 extends upward from the plate top surface 23. In the illustrated embodiment, the upright component 54 is oriented orthogonally relative to the top surface 23. However, the upright component 54 could be oriented at various angles relative to the top surface 23 and remain within the scope of the invention. The upright component 54 supports a planar component 60. The planar component 60 is spaced apart from the plate 22 by the upright component 54. In the illustrated embodiment, the planar component 60 is located at the top end of the upright component 54 and is substantially parallel to the top surface 23 of the plate 22. It will be appreciated that the planar component 60 also could be located at various points along the length of the upright component 54. Furthermore, the planar component 60 could also be diagonally oriented relative to the plate 22. The planar component 60 extends outwardly from the upright component 54 so that the cross-section of the front rail 46 is generally "T"-shaped.

As shown in FIG. 2, the rear rail 50 is located on the rear section 30 of the plate member 22 on a side of the aperture 34 opposite the front rail 46. The rear rail 50 includes an upright component 62 that extends upwardly from the top surface 23. The upright component 62 of the rear rail 50 supports a planar component 64. The planar component is substantially parallel to the plate 22 and extends outwardly from the upper end of the upright component 62. It will be appreciated that the planar component 64 could be located at various points along the length of the upright component 62 and could also be oriented at an angle relative to the plate top surface 23. The rear rail 50 has a generally "T"-shaped cross section.

As shown in FIG. 2, a notch 66 is located on the rear rail 50. Preferably, the notch 66 is located at the midpoint of the length of the planar component 64, as best shown in FIG. 3. In the illustrated embodiment, the notch 66 extends partially into the planar component 64 up to where the upright component 62 intersects the planar component 64.

Referring to FIG. 3, the front and rear rails 46 and 50 each have an elongated, arcuate shape with the concave sides of the rails 46, 50 facing the aperture 34. Preferably, the rails 46, 50 each have the same radius of curvature, with the curvature being uniform through the length of the rails. In a preferred embodiment, the radius of curvature is defined by a circle having a center point that is aligned with the center point of the circular aperture 34.

Referring to FIG. 3, the front and rear rails 46, 50 preferably have rounded ends. The rounded shape of the ends of the front and rear rails 46, 50 facilitates the insertion of the rails into the footwear member 70, as described more fully below.

The binding member 20 could have a wide variety of dimensions configured for various foot sizes. For an exemplary binding member 20, the aperture 34 has a diameter of 3 inches. The diameter of the circular recess 36 is 3.9 inches. The upright components 54, 62 of the rails 46, 50 are each 0.5 inches wide. The planar components 60, 64 are each 0.160 inches thick and 1 inch wide. There is a distance of 0.410 inches between the top surface 23 of the plate 22 and the bottom of each of the planar components 60, 64. The distance between the plate bottom surface 25 and the top of the planar components 60, 64 is about 0.850 inches. The plate 22 is 0.280 inches thick. The radius of curvature of the rails 46 and 50 is approximately 2.845 inches from the center point of the circular aperture 34 to the centerline of the thickness of the rails.

Footwear Member

Figure 4:
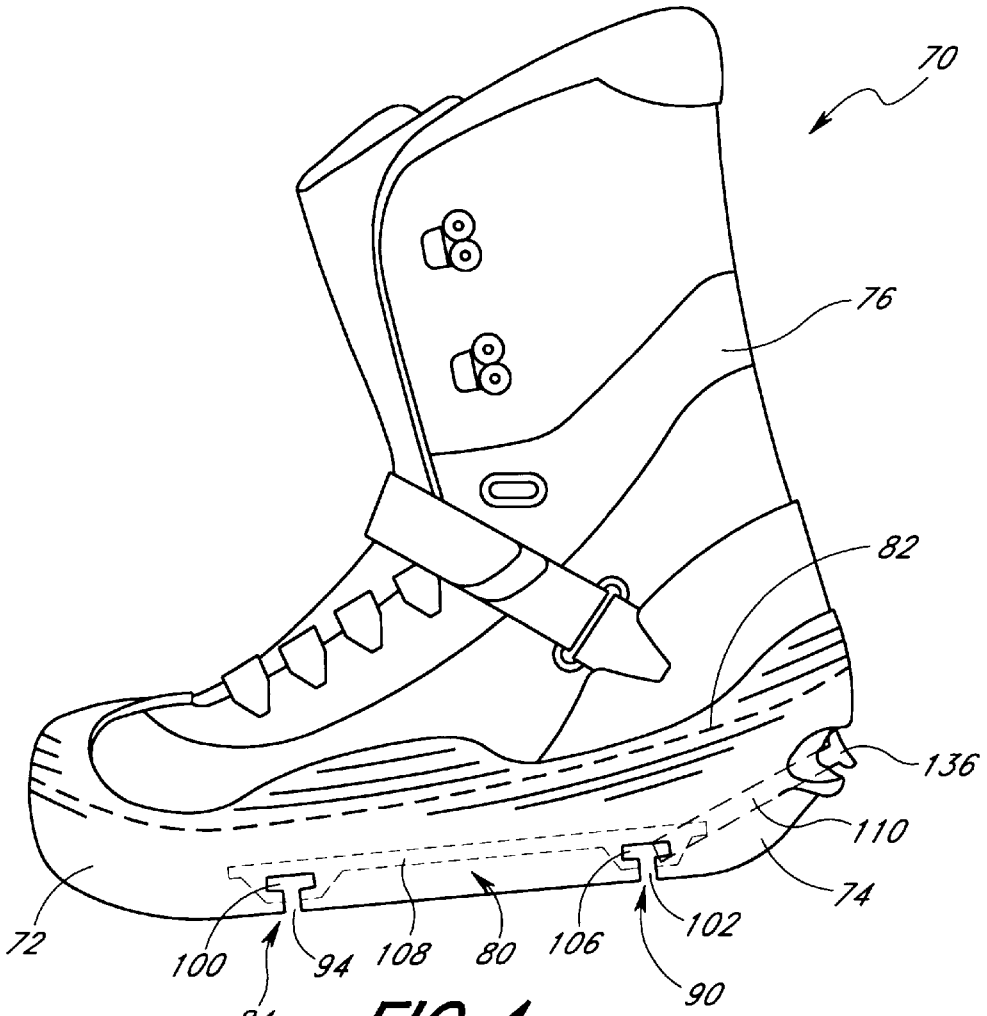
FIG. 4 illustrates a side view of a footwear member of the present invention that may be coupled with the binding member illustrated in FIG. 1.

FIG. 4 illustrates a footwear member 70 that is configured to mate with the binding member 20, as described below. In the illustrated embodiment, the footwear member 70 is depicted as a boot, such as is used for snowboarding. However, it will be appreciated that the footwear member 70 of the present invention is not limited to a boot, but could be any wide variety of footwear devices, such as a shoe. The footwear member 70 includes a front portion 72 and a rear portion 74. The front portion 72 generally supports the toe portion of the wearer's foot. The rear portion 74 generally supports the heel of the wearer's foot.

As shown in FIG. 4, the footwear member 70 includes an upper 76 that is configured to receive and enclose the wearer's foot. The upper 76 could be manufactured of any wide variety of materials known to those skilled in the art. A sole 80 wraps around the lower portion of the upper 76 and supports the upper 76 and the wearer's foot when the footwear member is worn. The sole 80 has a bottom surface 81 (FIG. 5) that is substantially flat. The bottom surface 81 integrally forms into a side surface 82, which wraps around the upper 76. The sole 80 could be manufactured of a wide variety of materials known to those skilled in the art, such as rubber or plastic.

With reference to FIG. 4, a front slot 84 and a rear slot 90 extend through the sole 80 of the footwear member 70. The front slot 84 has an upright section 94 that extends partially into the sole 80 from the bottom surface 81. The width of the upright section 94 is slightly greater than the width of the upright component of the front slot 46. The front slot 84 also has a transverse section 100 that is oriented at an angle relative to the upright section 94, preferably 90 degrees. The thickness of the transverse section 100 is slightly greater than the width of the planar component 60 of the front slot 46. As best shown in FIG. 4, the upright section 94 is oriented relative to the transverse section 100 so that the front slot 84 has a generally "T"-shaped cross section. Preferably, the T-shaped cross-section of the front slot 84 conforms to the shape of the T-shaped cross-section of the front rail 46 so that the front rail 46 may be slidably inserted into the front slot 84 through the side 82 of the sole 80.

With reference to FIG. 4, the rear slot 90 has an upright section 102. The upright section 102 extends into the sole 80 from the bottom surface 81. The upper end of the upright section 102 forms into a transverse section 106 that is oriented at an angle relative to the upright section 102, preferably 90 degrees. The rear slot 90 has a generally T-shaped cross section that is sized to slidably receive the rear rail 50.

As shown in FIG. 4, a support 108 could be inserted into the sole to provide rigidity to the shape of the front and rear slots 84, 90. The support 108 may be manufactured of a material that would generate a preferred level of friction between the rails 46, 50 and slots 84, 90. Plastic or other lightweight, rigid material may be used to manufacture the support 108.

Figure 5:
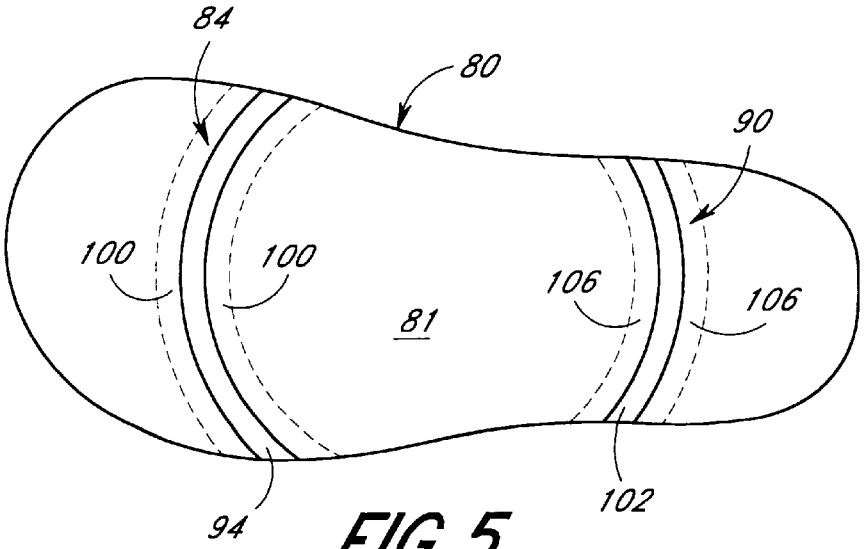
FIG. 5 illustrates a bottom plan view of the footwear member of FIG. 4.

Referring to FIG. 5, the front and rear slots 84 and 90 extend transverse across the sole 80 relative to the length of the footwear member 70. The front and rear slots 84 and 90 both have smooth arcuate shapes with the concave portion of the arcs facing each other. The curvature of the front slot 84 conforms to the curvature of the front rail 46 on the plate 22 and the curvature of the rear slot 90 conforms to the curvature of the rear rail 50. Furthermore, the front and rear slots 84, 90, are spaced apart from each other by the same distance that the front and rear rails 46, 50, are spaced from each other. Preferably, the curvature of the front and rear slots 84, 90 is defined by a circle having a radius substantially equal to the circle that defines the curvature of the rails 46 and 50.

Referring to FIG. 4, a shaft 110 extends into the sole 80. The shaft 110 extends from the rear side surface 82 of the sole 80 and into the rear slot 90 so that the shaft 110 communicates with the rear slot transverse section 106. The shaft 110 could define a wide variety of cross-sectional shapes.

Figure 6A:
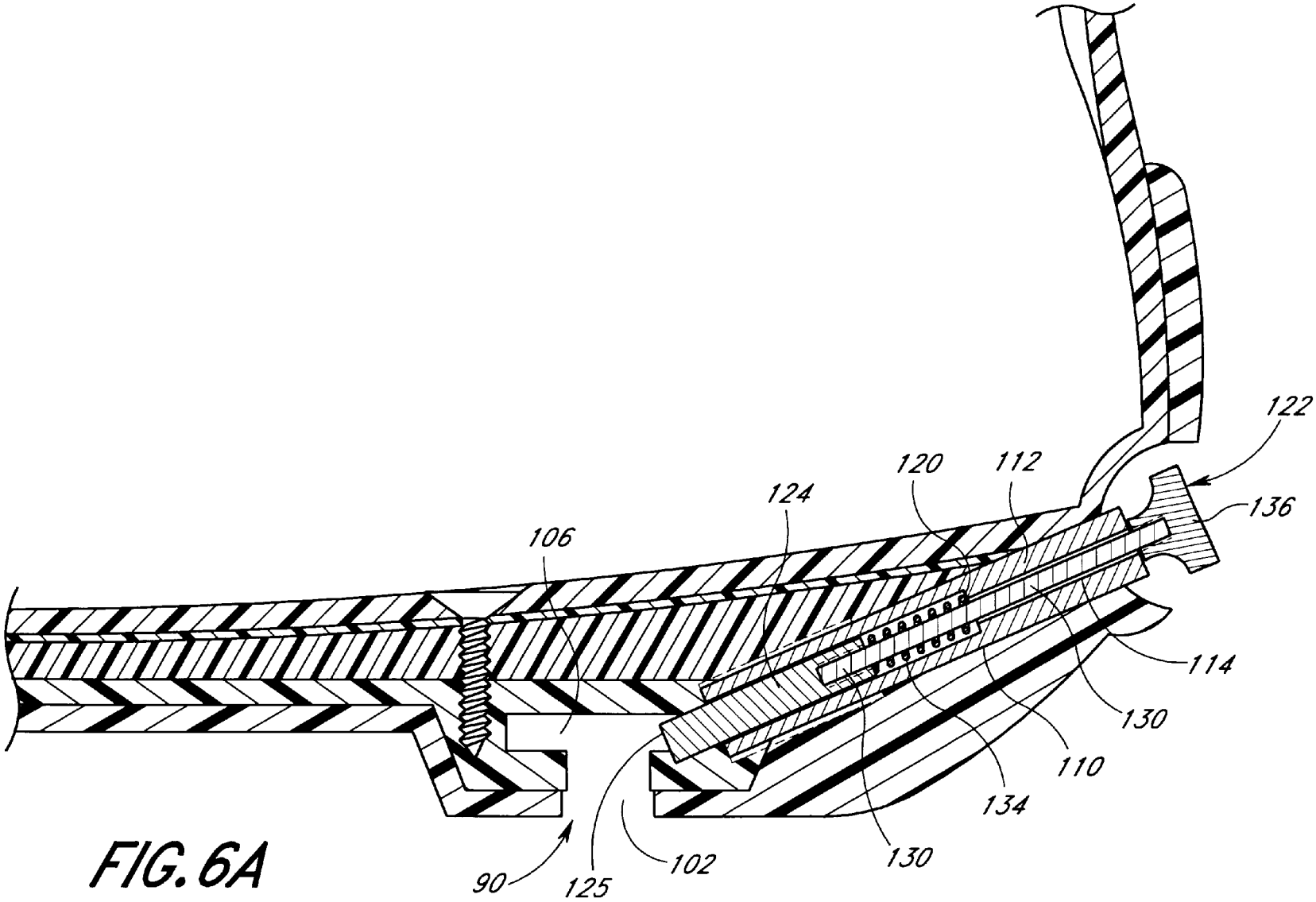
FIG. 6*a* illustrates a cross-sectional view of a portion of the footwear member of FIG. 4 showing a locking mechanism used with the footwear mounting system.

FIG. 6*a* illustrates a close-up cross sectional view of a locking mechanism 111, which is housed by the shaft 110. An annular sleeve 112 with an inner bore 114 is positioned snug within the shaft 110. The inner bore 114 has a reduced diameter along a portion of its length so that it defines a step 120 within the sleeve 112. A pin 122 is slidingly positioned within the inner bore 114. The pin 122 has a length greater than that of the shaft 110 so that the pin extends into the rear slot 90 and outward of the side surface 92 of the sole 80.

As shown in FIG. 6*a,* the pin 122 includes a detent section 124 having a distal end 125 that extends into the transverse section 106 of the rear slot 90. An extender section 130 is connected to the opposite end of the detent section 124. The extender section 130 has a smaller diameter than the locking section 124 so that an annular cavity is defined within the bore 114 between the step 120 and the detent section 124 of the pin 122. A biasing member 134, such as a spring, is located in the annular cavity. One end of the biasing member 134 presses against the locking pin 124. The other end of the biasing member 134 presses against the step 120. The biasing member 134 exerts a force against the locking section 124 of the pin 122 so that the distal end 125 tends to remain extended into the rear slot 90. A handle 136 is located on one end of the pin 122. The handle 136 may be pulled in the axial direction of the bore 114 to thereby slide the distal end 125 of the pin 122 out of the rear slot 90. When the handle 136 is released, the force exerted by the biasing member 134 returns the distal end 125 back into the slot 90.

Figure 6B:
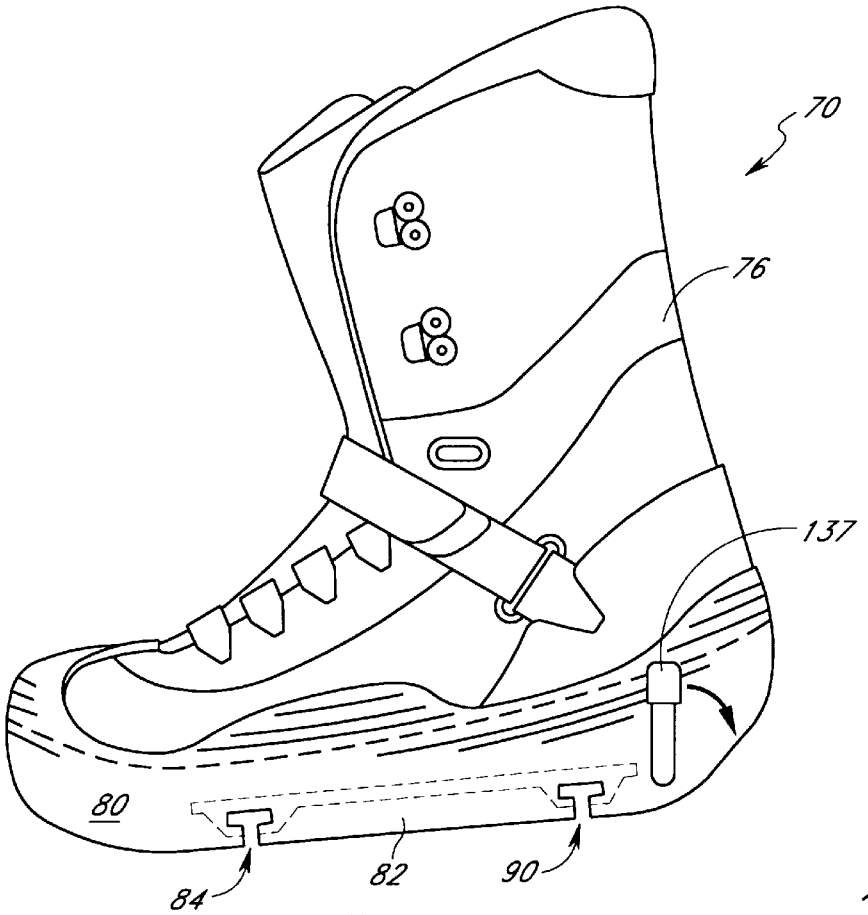
FIG. 6*b* illustrates a side view of the footwear member in accordance with a second embodiment of the locking mechanism used with the footwear mounting system.
Figure 6C:
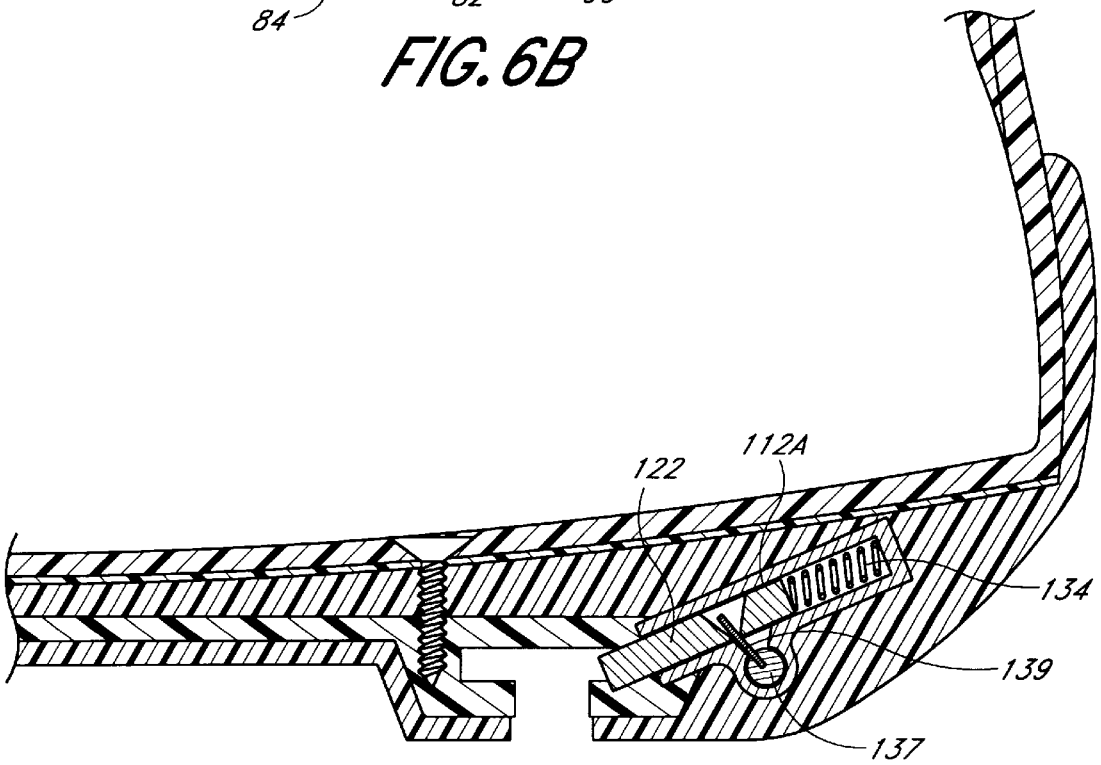
FIG. 6*c* illustrates a cross-sectional view of the second embodiment of the locking mechanism.

FIGS. 6*b* and 6*c* illustrate an alternative embodiment of the locking mechanism 111. As shown in FIG. 6*b,* a handle 137 extends outward from the side surface 82 of the sole 80. The handle 137 is rotatable about a pivot point 138. As shown in FIG. 6*c,* the handle 137 is connected to the pin 122 through a connector 139. The pin is housed in the shaft 112*a,* which in this embodiment extends only partially through the sole 80. The pin 122 is biased into the rear slot 90 by the biasing member 134.

The pin 122 may be moved out of the rear slot 90 by rotating the handle 137 in the direction of the arrow shown in FIG. 6*b*. When the handle is rotated as such, it causes the connector 139 to move in a direction away from the rear slot 90, thereby causing the end of the pin 122 to move out of the rear slot 90. When the handle 137 is released, the biasing member 134 forces the distal end 125 of the pin 122 back into the rear slot 90.

Method of Operation

Figure 7A:
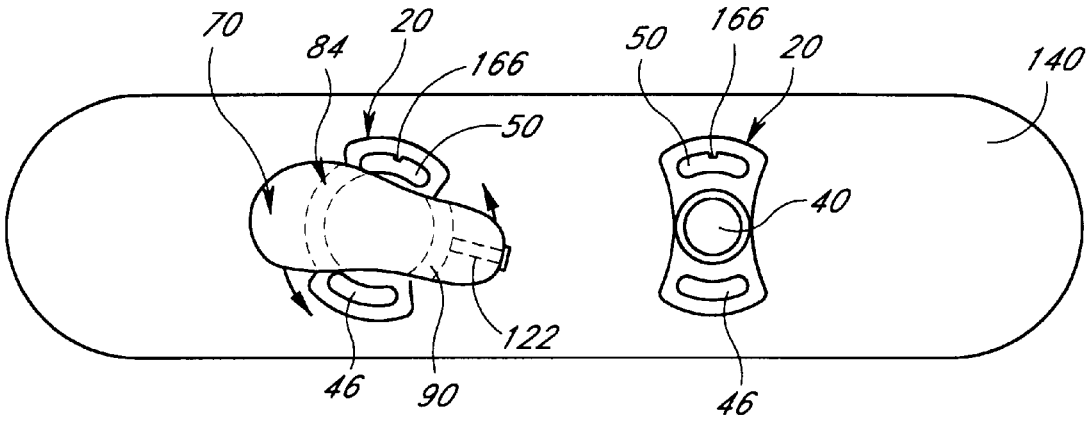
FIGS. 7*a*–7*c* illustrate a top plan view of the binding system of the present invention as used with a snowboard.
Figure 7B:
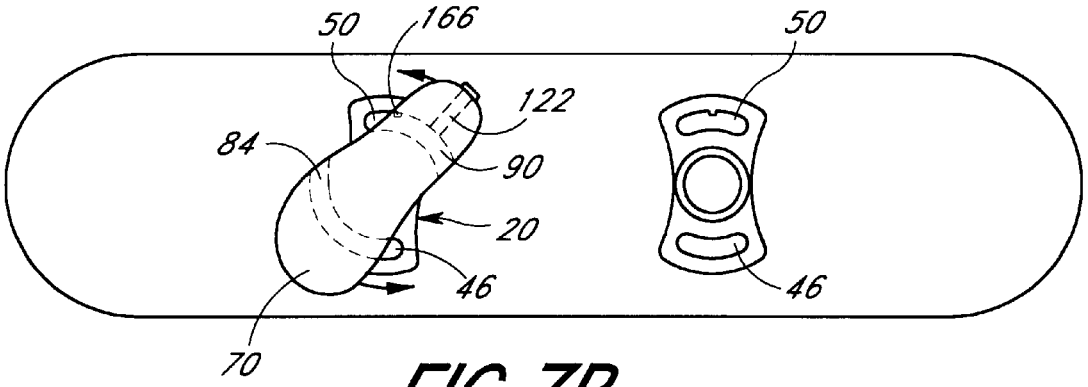
Figure 7C:
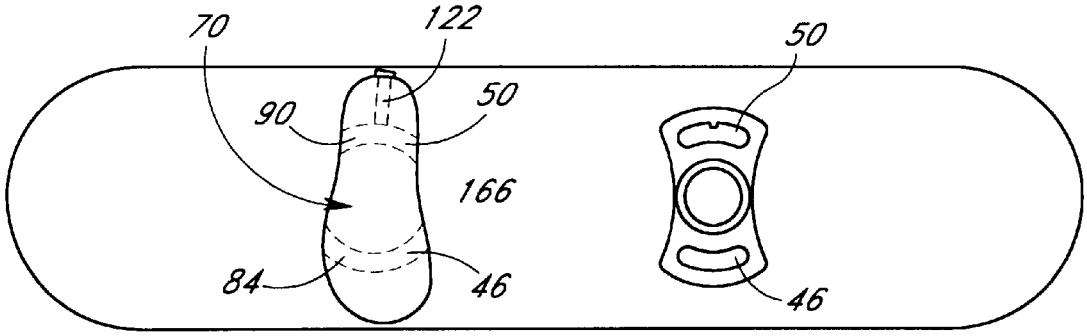

FIGS. 7*a* through 7*c* illustrate how the binding system 10 may be used to removably attach the footwear member 70 to a planar member, such as a snowboard 140. Referring to FIG. 7*a,* two binding members 20 are first mounted onto the snowboard 140, using the mounting device 40. As shown, for a snowboard, the binding members 20 are preferably oriented transverse relative to the longitudinal axis of the snowboard 140 so that a longitudinal centerline of the snowboard 140 lies between the front and rear rails 46, 50. Under this arrangement, the snowboarder's feet will be oriented in the conventional manner (i.e., transverse to the snowboard longitudinal axis) when the footwear members 70 are coupled with the binding members 20.

After the wearer (not shown) puts a footwear member 70 on each foot, he or she may then bind the footwear member 70 to the snowboard 140. First, the wearer positions his or her foot so that the bottom surface 81 of the sole 80 lies flatly adjacent the top surface 23 of the plate 22. As shown in FIG. 7*a,* the wearer's foot should initially be oriented so that the footwear member 70 lies between the rails 46 and 50 transverse to the binding member 20. The front and rear slots 84, 90, should then be aligned with the front and rear rails 46, 50, respectively. The footwear member 70 is then rotated in a direction substantially parallel to the plane of the snowboard 140 (as indicated by the arrows) so that the front and rear rails 46, 50 simultaneously slide into the front and rear slots 84, 90, respectively. Preferably, the curvature of the rails is such that the rails will smoothly slide into the slots. As discussed, in the preferred embodiment, the rails have a common radius of curvature that is defined by a circle, which preferably facilitates a smooth rotational insertion.

As discussed, the rails 46, 50 have rounded edges which preferably facilitates a smooth initial insertion of the rails into the slots. Furthermore, the rounded edges of the rear rail 50 preferably force the pin 122 to retract out of the rear slot 90 as the rear rail 50 slides into the rear slot 90. Alternatively, the wearer can manually pull the pin 122 outward using the pin handle 136 or 137.

At some point along the sliding motion, the pin 122 will align with the notch 66 in the rear rail 50. Preferably, the pin 122 and notch 66 align when the rails 46, 50 are fully inserted into the slots 84, 90, respectively. When the pin 122 aligns with the notch 66, the biasing member 134 forces the pin 122 to extend into the notch 166, as shown in FIG. 7*c*. In this position, the pin 122 acts as a detent to prevent any additional rotational movement between the rear rail 50 and the rear slot 90. This also prevents any additional sliding movement of the footwear member 70 relative to the binding member. A notch/pin arrangement could also be employed on the front rail 46 without departing from the scope of the present invention.

Preferably, when the rails 46, 50 are fully inserted into the slots 84, 90 and the pin 122 is engaged with the notch 66, the footwear member 70 will not move relative to the binding member 20, so that the footwear member 70 is secured to the snowboard 140. The mating relationship between the front and rear rail planar components 60, 64, and the front and rear slot transverse sections 96, 106, preferably prevents any movement of the footwear member 70 in a direction transverse to the plane of the snowboard 140, i.e., in a direction that intersects the plane of the snowboard. Likewise, the mating relationship between the rail upright components 54, 64 and the slot upright sections 94 and 102 prevents movement of the footwear member 70 in a direction parallel to the plane of the snowboard 140. Toward this end, the rails 46 and 50 should fit snug into the slots 84 and 90, respectively. Once inserted, a clearance of approximately ½ millimeter between the slots 84, 90 and the rails 46, 50, respectively, is desirable. It will be appreciated that the clearance distance between the rails and slots may be varied to suit various designs.

When the wearer wishes to remove the footwear member 70 from the binding member 20, the following steps are performed. First, the wearer pulls the pin 122 from the notch 66 using the pin handle 136 or 137. This allows the rails 46, 50 to slide within the slots 84, 90. The wearer may then simply rotate the footwear member 70 so that the rails 46, 50, slide out of the slots 84, 90, respectively.

There are certain advantages associated with the binding system of the present invention. First, the footwear member 70 mates to the binding member 20 in a way that facilitates the removal of debris from the slots 84, 90 during mating. As the rails 46, 50 slide into the slots 84, 90, the ends of the rails push against any debris within the slots. Preferably, debris is pushed out of the side 92 of the sole 80 when the rails are fully inserted into the slots. Because debris is automatically removed from the slots during the binding process, the wearer does not have to worry about manually removing any debris. The binding system 10 is thus easy and convenient to use Furthermore, the type of motion that a wearer performs in order to couple the footwear member 70 to the binding member 20 makes it easy to generate sufficient force to bind the objects together. As discussed, the footwear member 70 is slidably rotated onto the binding member 20. A wearer may generate sufficient torque to bind the footwear member 70 to the binding member 20 by simply rotating his or her foot at the ankle.

Additionally, the binding system 10 does not require that the wearer stoop or sit down in order to bind the footwear member 70 to the binding member 20. Because the wearer does not have to use his or her hands to couple the footwear member 70 to the binding member 20, the binding process may be easily performed while either standing or while sitting, such as while sitting on a chair lift.

Alternative Embodiments

Figure 8:
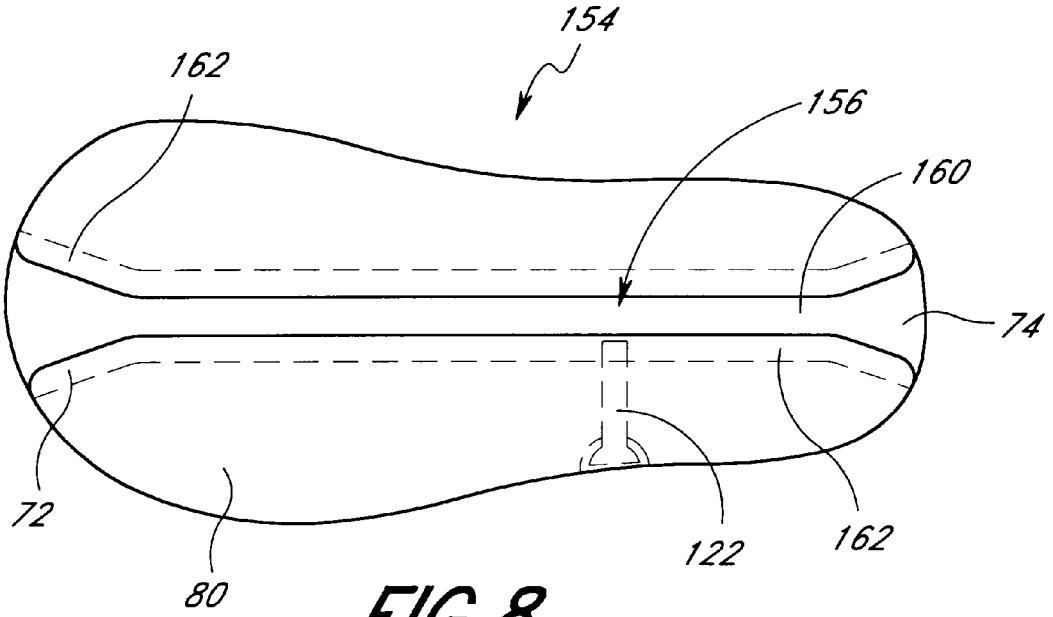
FIG. 8 is a bottom plan view of a footwear member in accordance with another embodiment of the present invention.
Figure 9:
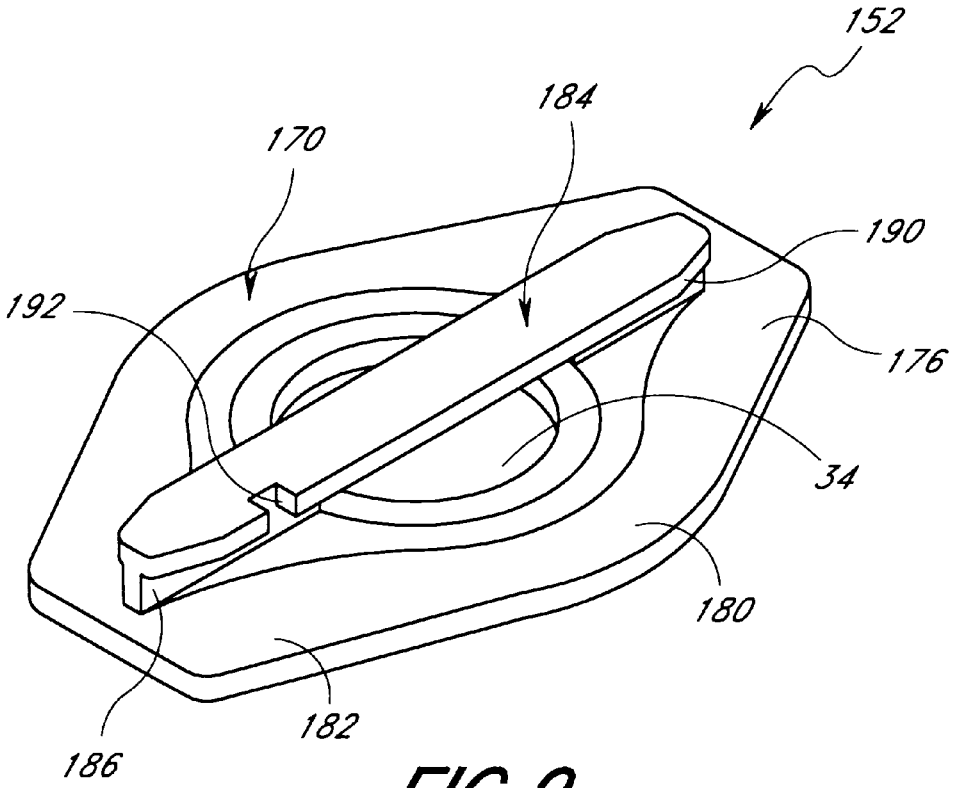
FIG. 9 is a perspective view of a binding member that is configured to be used with the footwear member illustrated in FIG. 7.

FIGS. 8 and 9 illustrate a binding system 150 in accordance with a second embodiment of the present invention. The binding system 150 includes a binding member 152 and a footwear member 154. The binding system 150 is similar to the binding system 10, as described above. For convenience, like reference numerals will refer to like objects.

The footwear member 154 is identical to the footwear member 70 of the previous embodiment in all aspects except the sole 80. FIG. 8 illustrates a bottom view of the sole 80 of the footwear member 154. A single slot 156 extends longitudinally across the sole 80, from the front portion 72 of the footwear member to the rear portion 74. The slot 156 has a T-shaped cross section similar to the cross sections of the slots 84, 90 of the previous embodiment. The slot 156 includes an upright section 160 and a transverse section 162. As shown in FIG. 8, the width of the slot 156 preferably widens at opposite ends of the slot 156 to facilitate initial insertion of a rail into the slot 156.

Referring to FIG. 8, a pin 122 (shown in phantom) extends through the sole 80 from a side of the footwear member 154 and into the slot 156. The pin 122 is configured in the same manner as in the previous embodiment so that the pin 122 is spring-biased to remain extended into the slot 156.

FIG. 9 illustrates a binding member 152 that is configured to mate with the footwear member 154. The binding member includes a substantially planar plate 170 having a circular aperture 34 that is preferably centered on the plate 170. The aperture 34 is configured to receive a mounting device (not shown) for mounting the plate 170 to a planar member, such as a snowboard (not shown), as described above with respect to the previous embodiment. The plate 170 has a front section 176, a middle section 180 and a rear section 182. In the illustrated embodiment, the middle section 180 has an increased width so that the plate 170 has a substantially oval shape. However, the plate 170 could have a wide variety of shapes.

As shown in FIG. 9, a single rail 184 is located on the plate 170. The rail 184 extends from the front section 176 to the rear section 182. The rail 184 has an upright component 186 that supports a substantially horizontal planar component 190, giving the rail 184 a T-shaped cross section. The cross-sectional shape of the rail 184 is sized to be slidingly inserted into the slot 156 on the footwear member 154. A notch 192 is located along the length of the horizontal member 190. The notch 192 is configured to receive the pin 122 when the rail 184 is fully inserted into the slot 156.

It will be appreciated that the configurations illustrated in FIGS. 8 and 9 could also be used with more than one rail 184 and a corresponding number of slots 156 in the footwear member 154. Furthermore, the rail 184 and slot 156 could also be oriented transverse relative to the length of the footwear member 154.

The binding system 150 is used by first mounting two binding members 152 to an object, such as a snowboard. The wearer, having a footwear member 154 on each foot, then attaches each footwear member 154 to a binding member 152 by slidingly inserting the rail 184 into the slots 156 of each footwear member 154. The rail 184 mates with the slot 156 using a straight sliding motion, rather than a rotational motion, as in the previous embodiment. The pin 122 in the footwear member 154 preferably engages with the notch 192 in the rail 184 once the rail 184 is fully inserted into the slot 156 to secure the footwear member 154 in place. As in the previous embodiment, any debris that is in the slot 156 will advantageously be forced out of the slot 156 by the rail 184 as the rail 184 is slidingly inserted into the slot 156.

Figure 10A:
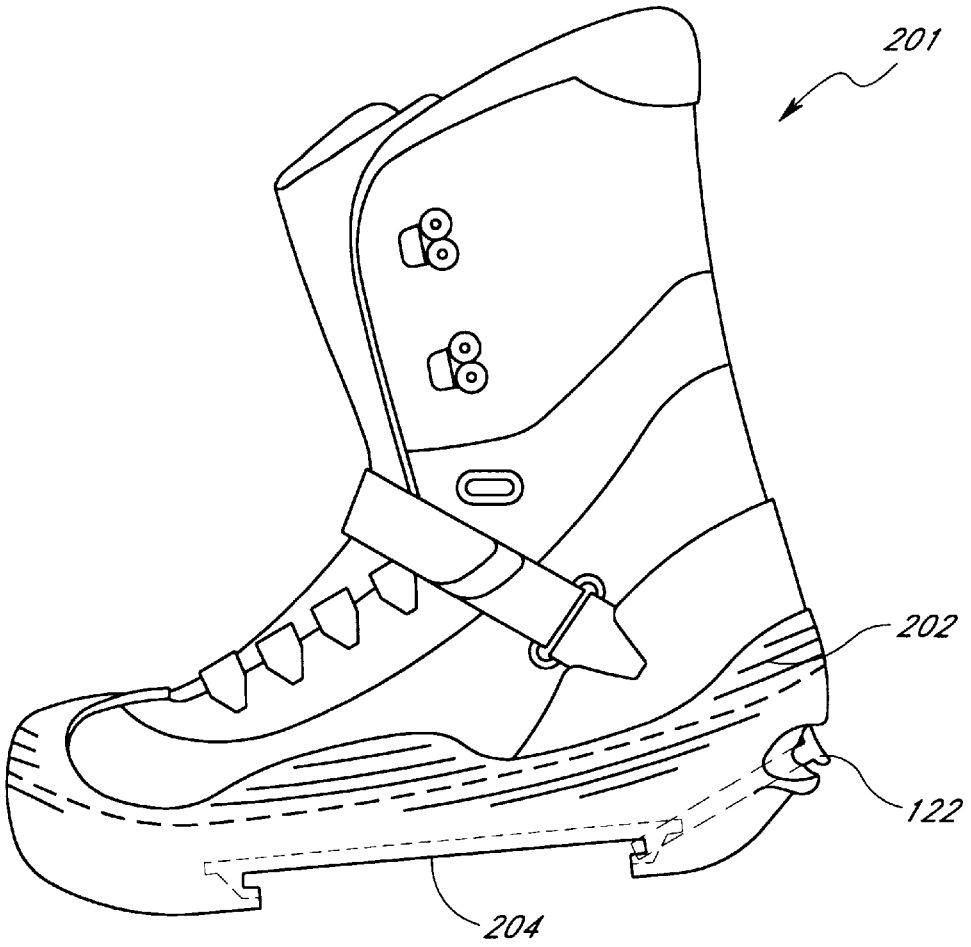
FIG. 10*a* is a side view of another embodiment of a footwear member of the present invention.
Figure 10B:
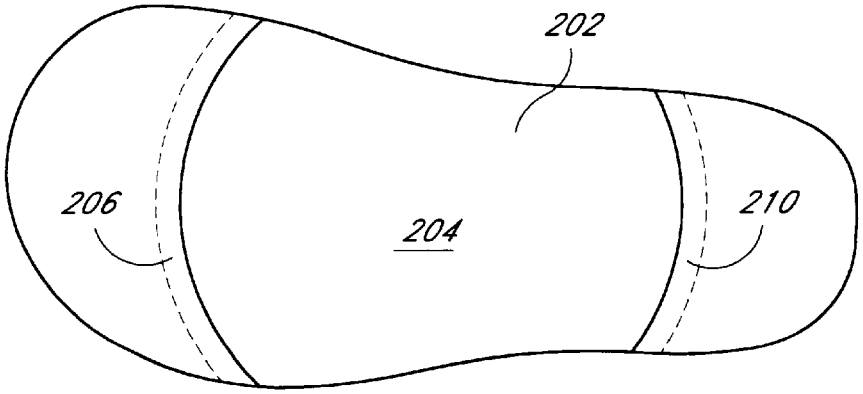

FIGS. 10*a,* 10*b,* and 11 illustrate a binding system 200 in accordance with yet another embodiment of the present invention. A footwear member 201 is identical to the footwear members of the previous embodiments with the exception of the sole 202. As shown in FIG. 10*a,* the sole 202 has a single slot 204 that extends transversely across the middle section of sole 202. The slot 204 has a T-shaped cross section and covers a significant portion of the sole 202. As best shown in FIG. 10*b,* the slot 204 has arcuate front and rear outer edges 206, 208, respectively, that extend transversely across the sole 202.

Figure 11:
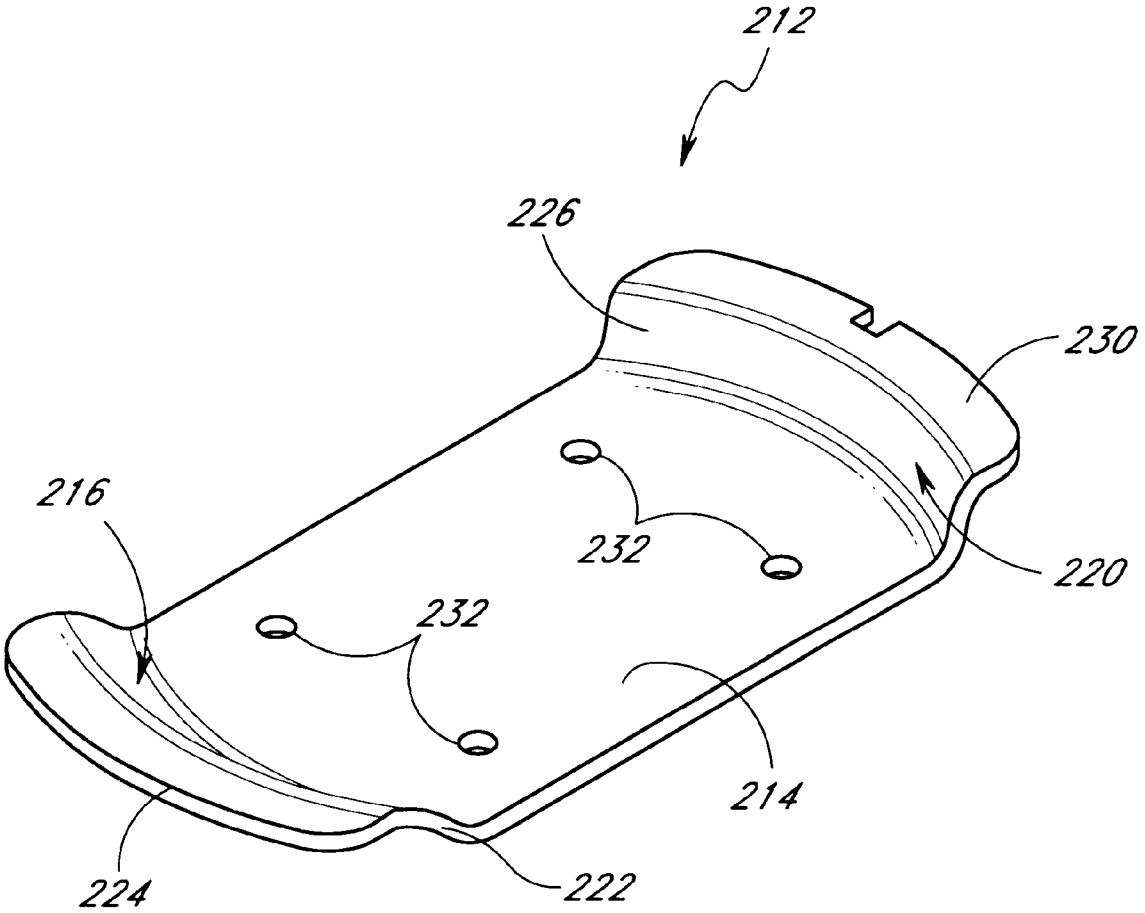
* and FIG. 11 is a perspective view of a binding member that is used with the footwear member illustrated in FIGS. 10*a* and 10*b*.

Referring to FIG. 11, a binding member 212 is configured to slidingly mate with the slot 204. The binding member 212 has a substantially planar section 214 and front and rear rail sections 216, 220, respectively. The front rail section 216 has an "L" shape, including an upright portion 222 that extends upward at an angle from the plate section 214. The upright portion 222 forms into a substantially horizontal portion 224 that extends in a direction away from the middle section 214 and is substantially parallel to the plate member 214. The shape of the front rail section 216 is compatible with the shape of the front edge 206 of the slot 204 in the footwear member 201. The rear rail section 220 mirrors the shape of the front rail section 216. The rear rail section 220 includes an upright portion 226 and a horizontal portion 230.

The binding member 212 may be mounted to a planar member, such as a snowboard, using screws (not shown) that fit within apertures 232 in the planar section 214. Alternatively, a mounting device 40 of the type described with respect to the previous embodiments could be used to attach the mounting member 212 to the planar member. The footwear member 201 is coupled to the binding member 212 by slidingly inserting the rail sections 220, 222 into the slot 202. Specifically, the front rail section 224 fits within the front edge 206 of the slot 202. The rear rail section 220 fits within the rear edge 210 of the slot. The footwear member 201 mates with the binding member 212 using a rotational sliding movement.

The above-described binding systems have a number of advantages. Because they are simple in design, they are easily manufactured and have a reduced risk of malfunctioning. The locking pin is the only moving part of the binding system. The low number of moving parts increases the reliability and ease of use of the binding system. The manner in which the footwear member couples with the binding member is also advantageous. The slots have two open ends, so that the rails advantageously push any debris within the slots out of one of the open ends as the rails are inserted into the slots. Hence, the user does not have to clean the slots every time he or she couples the footwear member to the binding member. Furthermore, the binding procedure can be performed while standing so that the wearer does not have to sit or stoop during binding.

Although the preferred embodiment of the present invention has disclosed the features of the invention as applied to these embodiments, it will be understood that various omissions, substitutions, and changes in the form of the detail of the embodiments illustrated may be made by those skilled in the art without departing from the spirit of the present invention. For example, the location of the rails and slots could be interchanged so that the rails are located on the footwear member and the slots are located on the sporting device. Consequently, the scope of the invention should not be limited to the foregoing disclosure but should be defined by the claims that follow.

What is claimed is:

1. A mounting system adapted for coupling a footwear member of a user to a snowboard, comprising:

at least one, first mounting device on said snowboard; and at least one, second corresponding mounting device on said footwear member adapted for engagement with said first mounting device on said snowboard, said first and second mounting devices engaging one another by rotational movement about the same axis and engaging one another in substantially the same engagement plane which is also substantially parallel to the mounting plane of said snowboard, said first mounting device comprising a first elongate, arcuate member and said second mounting device comprising a second elongate, arcuate member, said first and second arcuate members extending along the same radius of curvature and engaging one another over substantially their entire length;

said first and second mounting devices defining a solely manually-releasable mating engagement wherein said second mounting device and said first mounting device have the same cross-sectional shape, said mating engagement having a general cross-sectional configuration comprising:

at least one upright member to prevent relative movement between said snowboard and said footwear member in a direction parallel to said engagement plane; and at least one planar member to prevent said snowboard from disengaging from said footwear member in a direction transverse to said engagement plane.

2. The mounting system of claim 1, wherein the first mounting device comprises a rail and the second mounting device comprises a slot.

3. The mounting system of claim 1, wherein said planar member is oriented substantially transverse with respect to said upright member.

4. The mounting system of claim 1, wherein said planar member and said upright member intersect one another.

5. The mounting system of claim 1, wherein said cross-sectional configuration of said mating engagement is generally T-shaped.

6. The mounting system of claim 1, wherein said cross-sectional configuration of said mating engagement is generally L-shaped.

7. The mounting system of claim 1, wherein said first mounting device comprises a pair of rails.

8. The mounting system of claim 7, wherein said pair of rails are separated by a distance corresponding to approximately the width of the footwear member.

9. The mounting system of claim 8, wherein said pair of rails are curved to facilitate rotatable engagement between said footwear member and said recreational device.

10. The mounting system of claim 9, wherein both rails within said pair of rails have a common radius of curvature.

11. The mounting system of claim 1, additionally comprising a locking mechanism for preventing slidable movement between said first and second mounting devices, said locking mechanism including a locking device in said footwear member and a bearing surface on said first mounting device, said locking device configured to removably engage said bearing surface.

12. The mounting system of claim 11, wherein said locking device is a pin and said bearing surface is a notch.

13. A mounting system adapted for coupling a footwear member of a user to a snowboard, comprising:

at least one, first arcuate mounting device on said snowboard; and at least one, second corresponding arcuate mounting device on said footwear member adapted for engagement with said mounting device on said snowboard, said first and second arcuate mounting devices slidably and rotatably engaging one another in substantially the same engagement plane along their respective arcuate lengths, said first and second mounting devices defining a solely manually-releasable mating engagement having a general T- or L-shaped cross-sectional configuration including at least a first portion to prevent relative movement between said snowboard and said footwear member in a direction parallel to said engagement plane, and at least a second portion to prevent said snowboard from automatically disengaging from said footwear member in response to external forces and in a direction substantially transverse to said engagement plane.

14. The mounting system of claim 13, wherein said first portion and said second portion of said cross-sectional configuration comprise are integrated with one another.

15. The mounting system of claim 13, wherein said first mounting device comprises an elongate, arcuate rail and said second mounting device comprises an elongate, arcuate slot, the rail and slot defining the same cross-sectional shape.

16. The mounting system of claim 15, wherein the elongate rail and the elongate slot both extend along a curve defined by a single radius.

17. A method of coupling a footwear member of a user to a snowboard, comprising:

positioning a first mounting device located on said footwear member substantially adjacent a second mounting device located on said such that said first and second mounting devices are aligned in substantially the same plane;

slidably and rotatably engaging said first mounting device with said second mounting device so that said second mounting device nests within said first mounting device, said second mounting device ejecting any debris located within said first mounting device as said second mounting device slidably and rotatably engages said first mounting device.

18. The method of claim 17, wherein slidably and rotatably engaging said first mounting device with said second mounting device comprises rotating said first and second mounting devices about the same axis of rotation.

19. The method of claim 17, wherein slidably and rotatably engaging said first mounting device with said second mounting device comprises sliding a male member having a generally T-shaped cross-section into a female male member having a T-shaped cross-section.

20. The method of claim 17, wherein slidably and rotatably engaging said first mounting device with said second mounting device comprises sliding the first mounting device into the second mounting device along a direction substantially parallel to a plane defined by the snowboard.

21. A mounting system adapted for coupling a footwear member of a user to a snowboard, comprising:

at least one, first mounting device on one of the snowboard or the footwear member; and at least one, second corresponding mounting device on the other of the snowboard or the footwear member, the second mounting device adapted for engagement with the first mounting device, the first and second mounting devices engaging one another by rotational movement about respective axes of rotation and engaging one another in substantially the same engagement plane, said engagement plane being substantially parallel to the mounting plane of the snowboard;

said first mounting device comprising a first arcuate male member and said second mounting device comprising a second arcuate female member, said first and second arcuate male and female members both extending along respective radii of curvature and engaging one another over at least a portion of their respective lengths;

said first and second mounting devices defining a solely manually-releasable mating engagement defined by a generally L- or T-shaped cross-section.

22. The mounting system of claim 21, wherein said respective axes of rotation are substantially the same.

23. The mounting system of claim 21, wherein said radii of curvature are substantially the same.

24. The mounting system of claim 21, wherein the said first and second arcuate male and female members engage one another over substantially their entire length.

25. The mounting system of claim 21, wherein the first mounting device comprises a slot and the second mounting device comprises a rail.

26. A mounting system adapted for coupling a footwear member of a user to a snowboard, comprising:

an elongate male member on the snowboard, the male member extending along a curve defined by a radius;

an elongate female member extending through the sole of the footwear member, the female member extending along a curve defined by the same radius as the male member, the female member having a first open end and a second open end;

wherein the male member is rotatably slidable into the female member such that the male member ejects any debris located within the female member through the second open end of the female member.

27. The mounting system of claim 26, wherein the elongate male member comprises a rail and wherein the elongate female member comprises a slot.

28. The mounting system of claim 26, wherein the male member and female member each have a T-shaped cross-section.

29. A mounting system adapted for coupling a footwear member of a user to a snowboard, comprising:

first and second elongate slots on the sole of the footwear member, the first and second elongate slots each being open on opposite ends thereof;

first and second elongate rails on the snowboard, the first and second elongate rails having a cross-sectional shape that conforms to the cross-sectional shape of the first and second elongate slots, the first and second elongate rails being slidably and simultaneously mateable with the first and second elongate slots, respectively, so that the first and second elongate rails eject debris from the first and second elongate slots during mating;

wherein the first and second elongate slots and the first and second elongate rails extend along a curve defined by a common radius of curvature.

30. A mounting system adapted for coupling a footwear member of a user to a snowboard, comprising:

at least one curved female member on one of the footwear member or the snowboard;

at least one curved male member on the other of the footwear member or the snowboard, the male member sized to rotatably and slidably mate with the female member, wherein the male member and the female member have cross-sectional shapes that prevent the male member from disengaging from the female member along a direction transverse to the plane of the snowboard when the male member is mated with the female member.

* * * * *